United States Patent [19]

Clark et al.

[11] 4,017,142

[45] Apr. 12, 1977

[54] SELF-STAKING CIRCUIT BOARD PIN CONTACT

[75] Inventors: Stephen Larry Clark, Rossville; William Charles Thoms, East Berlin, both of Pa.

[73] Assignee: E. I. Du Pont de Nemours and Company, Wilmington, Del.

[22] Filed: Jan. 12, 1976

[21] Appl. No.: 648,514

Related U.S. Application Data

[63] Continuation-in-part of Ser. No. 558,421, March 14, 1975, abandoned.

[52] U.S. Cl. ..... 339/220 T; 339/17 R; 85/71; 85/38

[51] Int. Cl.[2] ..... H01R 9/08

[58] Field of Search ..... 339/17 R, 17 C, 220 R, 339/220 T, 275 R, 275 B, 275 T; 85/11, 38, 70, 71, 85

[56] References Cited

UNITED STATES PATENTS

| | | | |
|---|---|---|---|
| 2,333,930 | 11/1943 | Hedstrom | 85/38 |
| 2,597,344 | 5/1952 | Lang | 85/71 |
| 2,660,084 | 11/1953 | Newman | 85/38 |
| 2,673,336 | 3/1954 | Peters | 339/220 T |
| 2,972,727 | 2/1961 | Flanagan et al. | 339/220 R X |
| 3,276,309 | 10/1966 | Engstrom | 85/38 X |
| 3,428,934 | 2/1969 | Reider et al. | 339/17 R |
| 3,510,831 | 5/1970 | De Vito | 339/275 B X |

*Primary Examiner*—Gerald A. Dost
*Assistant Examiner*—Paul A. Bell

[57] ABSTRACT

A circuit board pin contact adapted to be mounted in a circuit board hole and staked in the hole upon collapse of the contact pin in the direction of insertion.

25 Claims, 23 Drawing Figures

Fig. 8
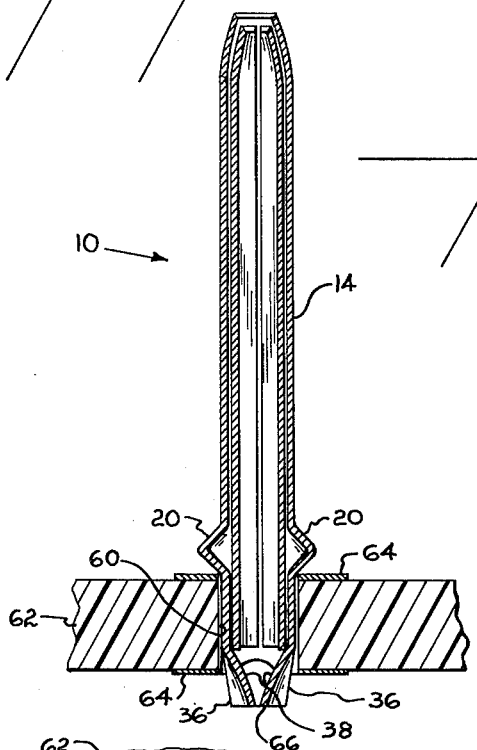
Fig. 9
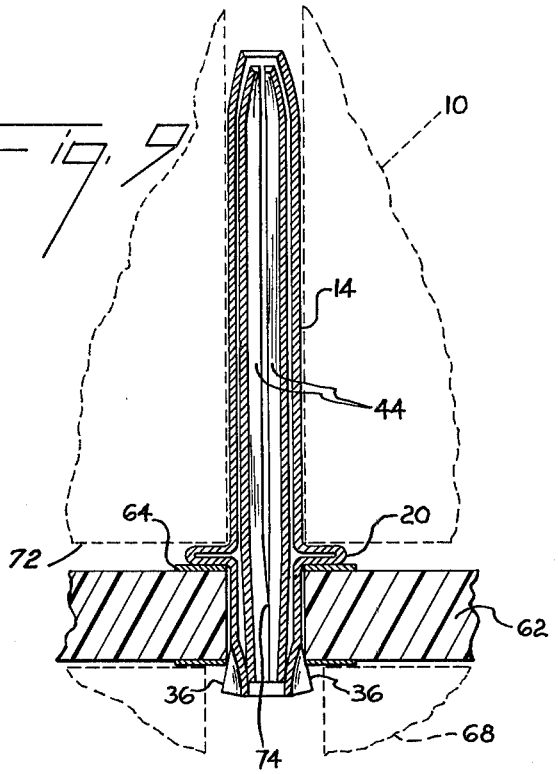
Fig. 11
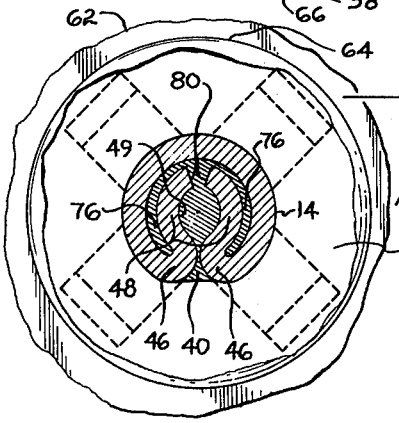
Fig. 10
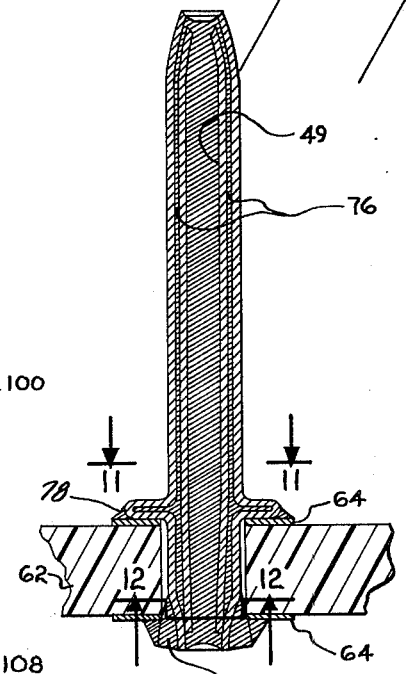
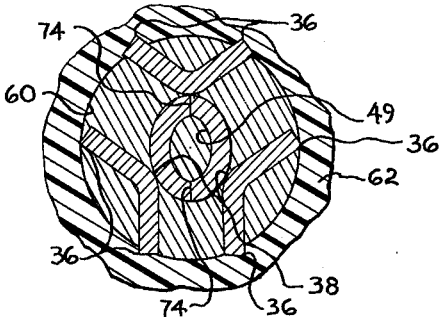
Fig. 12
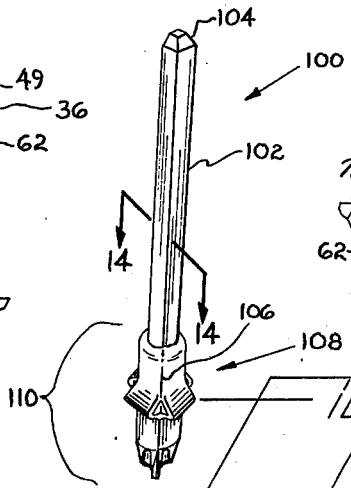
Fig. 13

Fig. 14
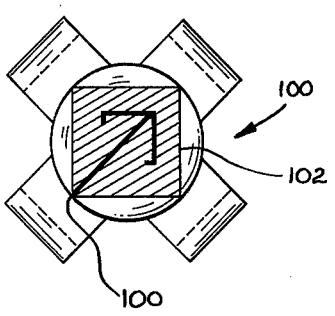
Fig. 15
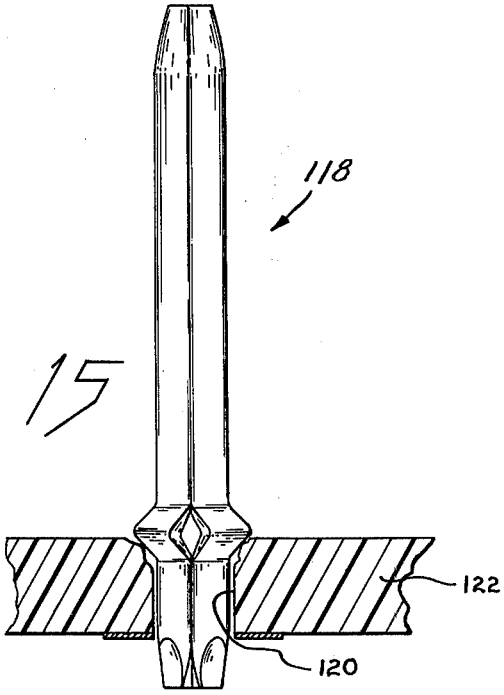
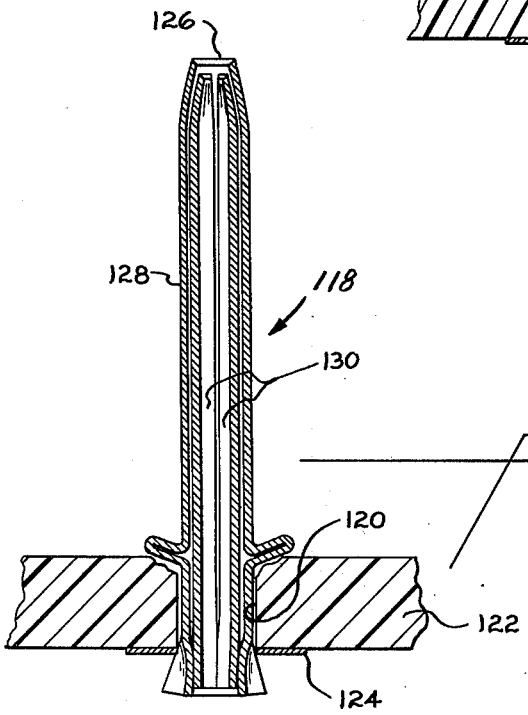
Fig. 16

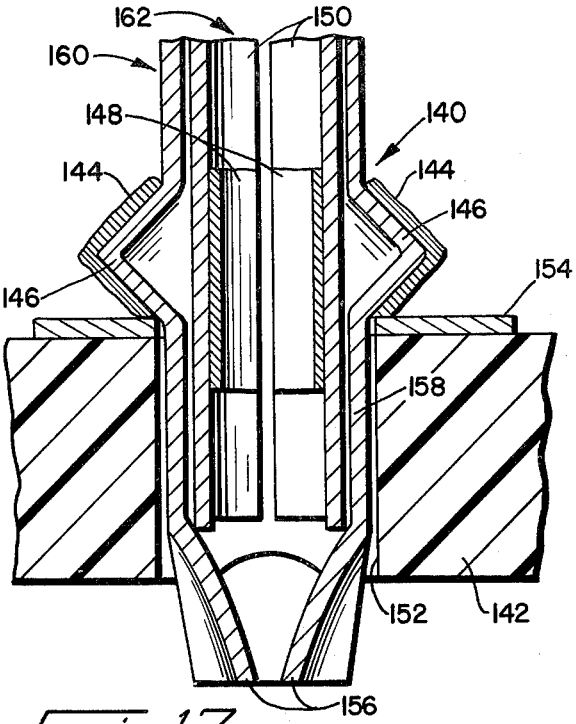
Fig. 17
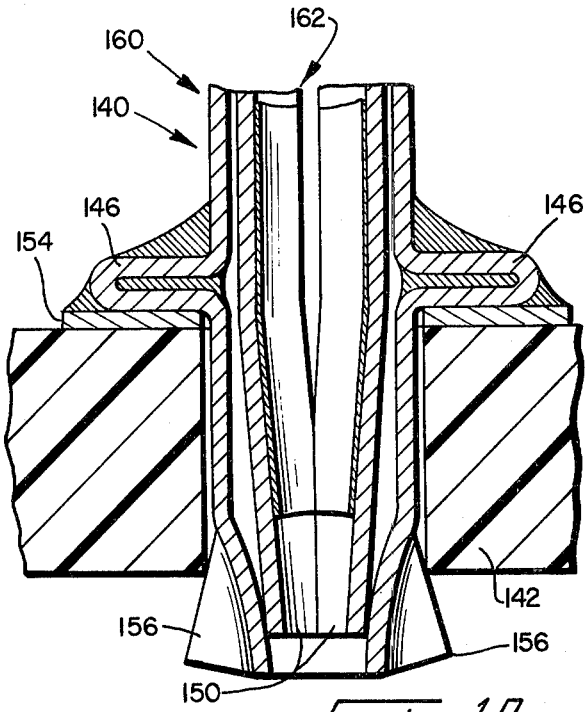
Fig. 18
Fig. 19
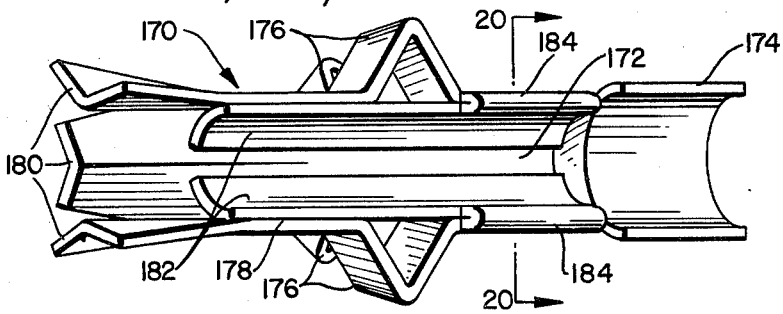
Fig. 20
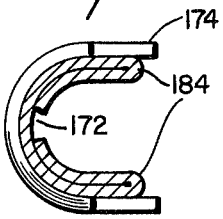
Fig. 21
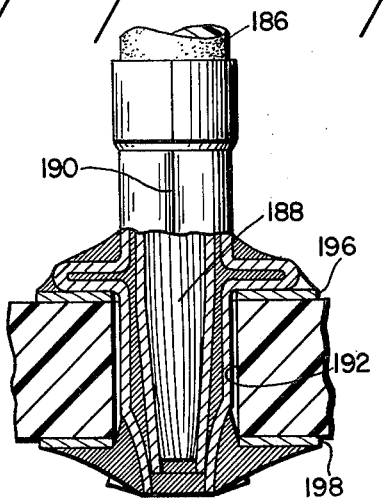
Fig 22
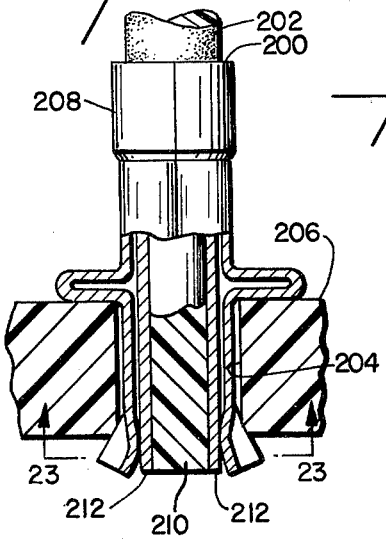
Fig. 23
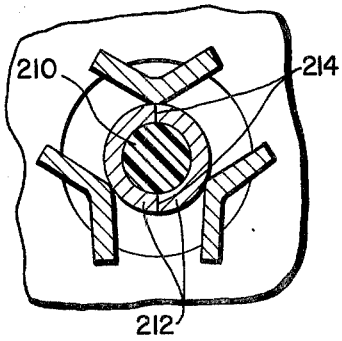

SELF-STAKING CIRCUIT BOARD PIN CONTACT

This application is a continuation-in-part of our copending application for "Self Staking Circuit Board Pin," Ser. No. 558,421, filed Mar. 14, 1975, now abandoned.

This invention relates to contact elements which are mounted in holes extending through circuit boards, panels and like supports and particularly to a self staking circuit board contact which is moved toward the circuit board from one side, seated in the hole and with further movement is physically secured to the hole to prevent accidental dislodgement. The contact may be subsequently soldered to the board. The pin is "self staked" to the board, that is it is positively secured to the circuit board without the use of tooling on the side of the board opposite the insertion side.

Circuit board contacts are conventionally inserted into circuit board holes from one side of the board and staked therein by tooling which deforms the lead-in end of the contact as it projects below the board as illustrated in U.S. Pat. No. 3,574,935. Also see U.S. Pat. No. 3,355,701. Circuit board components having legs with spring detents such that upon insertion into a circuit board hole the legs are bent inwardly and snap back on the other side of the board are shown in U.S. Pat. Nos. 2,950,458; 3,506,940; and 3,786,402. U.S. Pat. No. 3,777,303 discloses a circuit board hole liner having a latching member which is locked in the latch position upon insertion of a lead through the opening in the hole liner. U.S. Pat. No. 3,596,236 discloses a circuit board contact member which is fitted in a hole through a circuit board and includes deformable members on one side of the board which are connected to members on the other side of the board such that their deformation moves part of the contact through the thickness of the board to deform the members on the other side of the board. Also see U.S. Pat. No. 3,588,793 relating to a panel mount wedge connector used to form a ground connection, and U.S. Pat. Nos. 2,333,930 and 2,660,084 relating to blind rivet type fasteners.

Self staking circuit board pins, according to the invention, are intended for mounting on circuit boards in mass production through the use of assembly apparatus which stakes a large number of pins on a board in one operation. Individual pins are automatically dropped into selected circuit board holes with mounting portions fitted loosely within the holes and collapsible flanges or knuckle portions seated against the top surface of the board to locate the pin in the hole. An upwardly projecting portion of the pin joining the knuckle or flange portion is then pushed toward the board to collapse the knuckle or flange and move part of the pin located within the mounting portion down to engage petals or flanges at the lead end of the pin so that the petals or flanges move outwardly and bite into the inner surface of the circuit board hole adjacent the bottom of the board. This biting engagement of the petals with the board stakes the pin to the board with the collapsed knuckles or flanges held in tight engagement against the top of the board. The result is a tight physical connection between the pin and the board.

The deformable petals which stake the pin to the circuit board are inwardly dished to provide a pair of corners on their outer surfaces for engagement with the circuit board hole and cam surfaces on their inner surfaces for engagement with the member which forces the petals outwardly. The dishing, in combination with the width of the petals, provides an effective thickness greater than the thickness of the metal from which the petals are formed, thus assuring that the petals are bent outwardly sufficiently to force them into tight engagement with the circuit board.

Because the petals are positively pushed outwardly upon staking, the circuit board pin may be staked in circuit board holes having a range of diameters and lengths greater than the range tolerated by conventional elements which are staked to circuit boards by engagement with tooling on the side at which the staking occurs. This feature also allows the circuit board pin to be staked to boards having holes sufficiently large so that the mounting portion can be loosely fitted into the hole prior to staking. Further, there is no injury to the pin or circuit board hole during fitting of the pin into the hole. Initial insertion force is reduced because the pin can fall into the hole.

The pin includes a continuous solder flow path extending from the bottom of the circuit board up through the height of the pin so that upon soldering of the board molten solder is drawn up past the collapsed flange or knuckle and solder flow windows and into the elongate portion projecting above the board. Solder is also drawn up the pin along an additional solder flow path defined by the interior surface of the mounting and projecting portions and the exterior surface of the inner member defining the first solder flow path. Solder flowing along the second solder flow path also flows out windows in the collapsible or knuckle portion to form a solder joint between the pin and a contact pad on the top of the board, if there is such a pad. After soldering, the interior of the pin both above and below the circuit board is filled with solder, thus increasing the rigidity of the pin and also improving its electrical current-carrying capacity.

The pin is preferably stamp-formed from flat sheet metal stock and includes an upwardly extending tubular portion adapted to receive a female disconnect terminal. Undesirable raw edges are eliminated on the surface of the pin so that corrosion products do not form on the pin and the female disconnect terminals are not injured during insertion upon the pin. If desired, the free end of the pin may be tapered to facilitate mounting of the disconnect socket terminal on the end.

Another embodiment of the invention relates to a crimp-type self staking contact which is adapted to be crimped to either an electrical or fiber optic conductor and staked to a circuit board or like support panel to form a physical connection between the conductor and the board or panel. Where the contact is crimped to an electrical conductor a subsequent soldering operation forms the desired electrical connection between the conductor and printed circuitry on the circuit board. The free end of the fiber optic conductor crimped within the connector is exposed on the non-insertion side of the board or panel to permit transmission of light to the fiber optic member to such side, or alternatively, from such side through the fiber optic member to a remote area.

The crimp-type contact includes collapsible knuckles and petals similar to those of the self staking circuit board pin. The contact is manufactured from strip stock in an open configuration to provide a U-shaped crimp barrel and a U-shaped mounting portion such that the conductor, whether optically or electrically conductive, may be positioned within the contact prior to crimping. Following the crimping operation the contact is piloted into a circuit board hole or a hole in a support panel to seat the knuckles against one side of the board or panel following which continued movement toward the board or panel collapses the knuckles and moves the staking member against the petals to force them radially outwardly and physically secure the contact in place. In the case that the contact is crimped to a fiber optic member the edges of the pair of outwardly bowed strips forming the staking element abutt each other to prevent undue radial pressure on the relatively delicate fiber optic member during collapse and staking to the contact.

A heavy coating of solder may be provided on the outer surfaces of the collapsible knuckles so that following staking and heating the solder melts to form a soldered joint between the collapsed knuckles and printed circuitry on the insertion side of the board. In this way, the pin or element may be soldered to the circuitry on the insertion side of the board without the necessity of wave-soldering the non-insertion side of the board. A solder coating may be provided on the inner surfaces of the staking strips to form a soldered joint between the strips and an electrical conductor positioned between the strips.

Other objects and features of the invention will become apparent as the description proceeds, especially when taken in conjunction with the accompanying drawings illustrating the invention, of which there are four sheets.

IN THE DRAWINGS

FIG. 1 is a side elevational view of a circuit board pin according to the invention;

FIGS. 2, 3, 4, and 5 are sectional views taken along lines 2—2, 3—3, 4—4, and 5—5 of FIGS. 1, 2, 1, and 1 respectively;

FIGS. 8 and 9 are sectional views of the pin taken along line 8—8 of FIG. 4 illustrating the pin positioned on a circuit board prior to and after staking to the board;

FIG. 10 is a sectional view similar to FIG. 9 after soldering of the pin to the board;

FIGS. 11 and 12 are sectional views taken along lines 11—11 and 12—12 respectively of FIG. 10;

FIG. 13 is a perspective view of a modified pin according to the invention;

FIG. 14 is a sectional view taken along line 14—14 of FIG. 13;

FIGS. 15 and 16 illustrate positioning of the pin in a punched circuit board hole with break out and subsequent staking of the pin in such hole;

FIGS. 17 and 18 are similar to FIGS. 8 and 9 and illustrate a further embodiment of the invention;

FIG. 19 is a side elevational view of a crimp-type self staking contact;

FIG. 20 is a sectional view taken along line 20—20 of FIG. 19;

FIG. 21 is a partially broken away view of the contact of FIG. 19 crimped to an electrical conductor and staked to a circuit board;

FIG. 22 is a partially broken away view of a contact like that of FIG. 19 crimped to a fiber optic member and staked to a support panel; and FIG. 23 is a sectional view taken along line 23—23 of FIG. 22.

Figure 4:
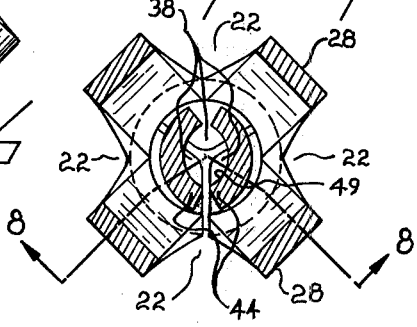
Figure 5:
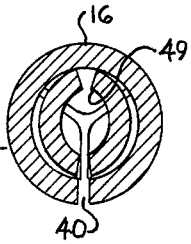

The self staking circuit board pin 10 is preferably stamp formed from a flat sheet metal preform 12 and includes an elongate tubular body 14 at one end of the pin, a tubular mounting portion 16 at the other end of the pin and a collapsible knuckle portion 18 joining the body and mounting portions. The collapsible portion 18 includes four outwardly bent V-shaped knuckles spaced equally around the periphery of the pin to define four solder flow openings 22 between adjacent knuckles communicating the inside and outside of the pin as shown in FIG. 4. Each knuckle includes a leg 24 extending from the tubular body 14 and a leg 26 extending from the mounting portion 16, with the legs joining at a relatively sharp apex 28. The free end 30 of tubular body 14 is inwardly tapered to facilitate mounting a female disconnect terminal on the end of the pin 10 after the pin has been staked and soldered on a circuit board.

Figure 1:
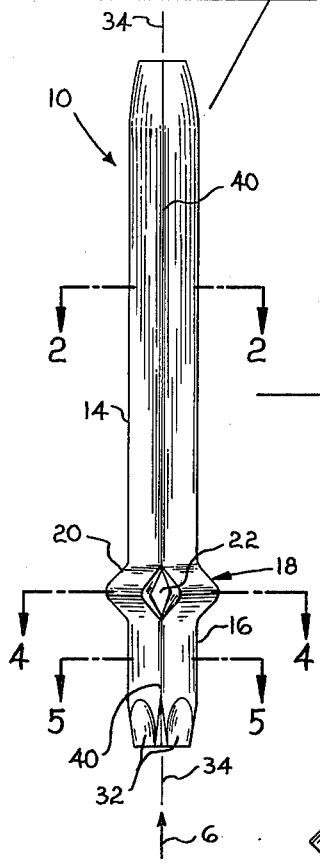
Figure 3:
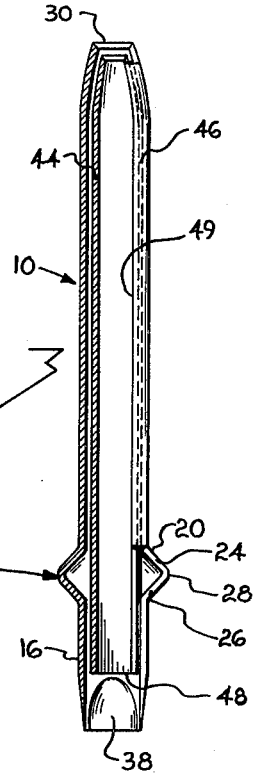
Figure 6:
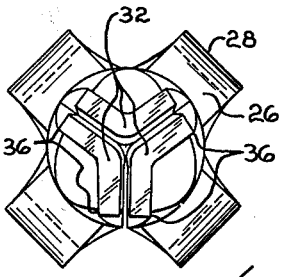
FIG. 6 is a view of the bottom of the pin illustrated in FIG. 1 taken in the direction of arrow 6.
Figure 2:
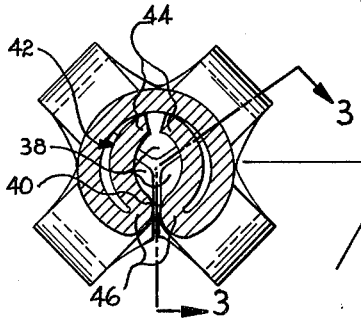

Three circuit board-engaging petals 32 are provided at the free end of the mounting portion 16 and extend radially inwardly toward the longitudinal axis 34 of the pin (See FIG. 1). The petals 32 are inwardly dished so that when together they close the interior of the mounting portion. Each petal includes a pair of circuit board hole-engaging corners 36 located on the outside surface of the petal and a longitudinally extending camming surface 38 located midway between the edges of the petals on the inner surface. As shown in FIG. 2, the camming surfaces 38 converge with each other adjacent the longitudinal axis 34.

Longitudinal seam 40 extends along the one side of body 14, through a solder flow opening 22, along one side of the mounting portion 16, and between a pair of petals 32. An inner tubular body 42 surrounded by the body 14, collapsible knuckle portion 18 and mounting portion 16 includes a pair of outwardly bowed elongate strips 44. Each strip 44 is joined to the body 14 at one side of seam 40 through a reverse bend portion 46 which extends along the body 14 from the collapsible portion 18 to free end 30. The strips 44 extend from body 14 past the collapsible portion 18 and into the mounting portion 16 with the free ends 48 of the strips positioned immediately above the camming surfaces 38 on the inner sides of the petals. The strips are radially outwardly bowed in planes transverse to the axis 34 so that their outer sides are adjacent and slightly spaced from the inner surface of the body 14. The inner concave surfaces of the strips 44 define a hollow continuous solder flow path 49 extending from the interior of the mounting portion 16, past the collapsible portion 18, and up to the free end 30 of body 14.

Figure 7:
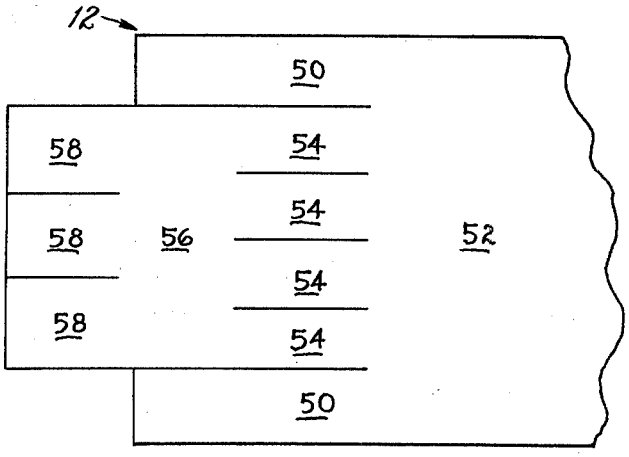
FIG. 7 is a fragmentary illustration of a flat metal preform used in the manufacture of the pin.

The blank 12 illustrated in FIG. 7 includes two side portions 50, a central portion 52, four strips 54, an end portion 56 and three tabs 58. Slits are provided to either side of the tabs and strips. The right hand end of the preform 12 is broken away to indicate that the central portion and side portions may be of a given length, depending upon the length of the pin above the collapsible portion. In the manufacturing operation used to form the pin 10 from the blank 12, the central portion 52 becomes body 14, side portions 50 become strips 44, strips 54 become knuckles 20, portion 56 becomes mounting portion 16, and strips 58 become petals 32.

The pin is mounted in and soldered to a circuit board as illustrated in FIGS. 8 through 12. The mounting portion is loosely fitted into a circuit board hole 60 extending through the thickness of circuit board 62, which may have printed contact pads 64 on both sides of the board. The loose fit of the mounting portion in the hole facilitates mounting of pins in mass pin assembly, as the pin may simply be dropped into the hole without the necessity of forcing the pin into the hole. Injury to the pin or hole during insertion is avoided, together with the problem of aligning the pin exactly with the hole.

The pin moves into the circuit board hole until the outwardly projecting knuckles 20 rest on the upper surface of the board, in this case the upper contact pad 64. The corners 36 of the petals 32 extend radially inwardly toward the free end 66 of the pin to provide lead-in for ease of entry into hole 60. As shown in FIG. 8, the petals and corners may extend from within the hole 60 below the lower surface of the board 62.

The circuit board pin 10 is staked to board 62 as illustrated in FIG. 9. Board 62 is positioned on a support 68 having an opening below circuit board hole 60. A staking tool 70 having a cylindrical bore slightly greater in diameter than the diameter of the body 14 is positioned over the body 14 so that the lower staking surface 72 of the tool engages the knuckles 20 and, with movement of the tool 70 toward the fixed board 62, collapses the legs of the knuckles flat against each other as illustrated. Legs 24 and 26 are of equal length, thus facilitating flat collapse of the knuckles. Collapse of the knuckles lowers the elongate tubular body 14 and the strips 44 which are integral therewith so that the free ends 48 of the strips are moved down with respect to the fixed mounting portion 16 and petals 32. This downward movement brings the ends into engagement with the camming surface 38 on the insides of the petals and forces the ends of the strips together, as shown in FIG. 9, to collapse the seams 74 between the free ends of the strips as illustrated in FIGS. 9 and 12. Continued downward movement of the body 14 and strips bends the petals radially outwardly about their junctions with the mounting portion 16 so that the circuit board engaging corners 36 bite into the circuit board at the lower end of the hole 60. See FIG. 12 which shows the corners 36 embedded into the circuit board material. The inward dishing and width of the petals increases the effective radial thickness of the petals so that the corners are radially spaced a distance from the camming surfaces 38 greater than the thickness of the metal stock from which the petals are formed.

Engagement between the petals and the circuit board forms a tight staked connection which physically secures the pin to the circuit board. This assures that the pin is held to the board without movement prior to soldering and is important since the relative elongate tubular body 14 of pin 10 may extend above the surface of the board a relatively great distance so that accidental movement of the free end 30 of a staked pin exerts a high force on the connection between the pin and the board. As an example of the strength of the staked connection, a pin having a mounting portion with a diameter of 0.045 inch was staked in a circuit board hole of 0.055 inch in diameter extending through a 0.062 inch thick glass filled phenolic circuit board. The pin was formed with 0.008 inch thick ½ hard brass stock. A force of ten pounds on the body portion 14 was required to pull the pin from the board. The tight physical connection between the staked pin and the board also assures that the connection is rigidly held on the board during soldering so that there is no relative movement between the pin and board during cooling of the molten solder.

Following staking of the pin to the board, molten solder is applied to the lower surface of the pin, conventionally by moving the board through a molten wave solder bath. The molten solder flows into the interior of the mounting portion 16 and wicks up the solder flow channel 76 between the strips 44 and the mounting portion to the solder flow windows 22 between adjacent collapsed knuckles. Solder flows through the windows and onto the adjacent pad 64 to form an electrical joint with the circuitry on the top of the board. Molten solder also continues to flow upwardly through the solder flow channel 76 to form a bond between the body 14 and the strips 44, thereby stiffening the pin.

At the same time, molten solder from the solder bath flows into the central solder flow path 49 between the outwardly bowed strips 44 and is drawn up the path into the portion of the pin above the board, thereby increasing the beam and torsional strength of the pin. Because the strips defining solder flow path 49 extend past the collapsed knuckles and windows 22, the knuckles and windows do not disrupt the upward flow of solder in the path. Solder may not flow all the way up the pin to end 30. This is a function of pin length and soldering conditions. Without the continuous solder path 49, solder applied to the underside of the board would tend not to rise above the windows 22 so that it would not be possible to fill the interior of the pin above the circuit board with solder and a much weaker pin would result. The use of solder to stiffen the pin is relatively inexpensive as compared to the cost of providing sufficient metal in the stamped pin to achieve an equivalent stiffness. This expendiency reduces the cost of the product by conserving pin metal.

As illustrated in FIGS. 10 and 11, solder fillets 78 and 80 are formed at the upper and lower circuit board contact pads 64 respectively. The fillets assure that a reliable interfacial connection is formed between the pin and each of the pads and between the pads themselves. While the pin is disclosed in connection with a double-sided circuit board, it is obvious that the pin may be staked to a circuit board having contact pads on but one side or, in certain circumstances, having no contact pads at the circuit board hole. In this situation, the pin may be used as a mounting terminal for forming an electrical connection between two disconnect sockets or other elements secured to the projecting body 14.

As illustrated in FIG. 11, the stock forming the body 14 is bent into the interior of the body at the seam 40 by reverse bends 46. This assures that there are no raw edges on the outer or contact surface of the pin. Such raw edges are undesirable as corrosion products tend to collect on them and the sharp corners at the edges injure mating parts. Raw edges 80 of the strips 44 are located within the body 14 away from the outer surface of the body.

After soldering, circuit board pins 10 may be used for plug-in engagement with female disconnects or other types of connectors. The current carrying capacity of the pin is greater than that of single thickness circuit board pins because of the increased metal cross sectional area of the pin due to the inner strips 44 and the solder within the pin. The solder and inner strips 44 in the pin 10 increase the current carrying capacity of the pin appreciably over that of a rolled single wall thickness pin.

As indicated in connection with the description of the blank 12, the length of the pin above the circuit board may be varied as described. A relatively short pin may be used or a relatively long pin, of the type illustrated, may be used. In each case, the strips 44 are integral with the body 14 so that upon collapse of the knuckles the strips are lowered and the petals are forced outwardly to engage the sides of the circuit board hole.

Pin 10 may be staked in circuit board holes having a greater range of diameters than tolerated by components which are staked into circuit board holes by bending flanges around the corners of the hole. For instance, a pin 10 where the mounting portion 16 has a diameter of 0.045 inch can be staked in circuit board holes having a diameter ranging from 0.045 inch up to 0.055 inch. Also, the thickness of the circuit board may be increased from a minimum to a thickness such that the petals do not extend below the board. During staking of the pin to a thick board, the petals are forced outwardly against the circuit board wall so that the entire length of the cutting corners 36 engage the wall, resulting in a strong physical connection between the pin and the board.

FIGS. 13 and 14 illustrate an embodiment of the invention where pin 100 is identical to pin 10 with the exception that upper portion 102 of the pin is stamp-formed so that the ends of the body 14 and strips 44 are deformed and portion 102 is square in cross section with a pyramidal lead-in 104 at the free end of the pin. Seam 106 extends from the collapsible knuckle portion 108 along a pin portion 110, which is identical to the corresponding portion 16 of pin 10, and thence along one corner of the square portion 102. As illustrated in FIG. 14, the corners of pin portion 102 are relatively sharp to facilitate wire wrap connections. Alternatively, disconnect sockets may be mounted on the portion 102. The strong stake connection between the pin and the circuit board, together with the soldered joint with circuitry on the board, if any, assures that the pin is held securely despite the torque applied during wrapping wires about portion 102.

FIGS. 15 and 16 illustrate staking of a pin 118, similar to pin 10, into a hole through a single-sided circuit board formed by punching. Punched holes are subject to break-out on the side away from the circuitry so that the diameter of the hole on that side is appreciably larger than the diameter of the hole on the circuitry side. Hole 120 extending through board 122 is broken out on the top side of the board. Circuitry 124 is on the bottom of the board. Circuit board pin 118 is readily staked to such a hole. The petal end is positioned into the hole from the bottom out side so that the knuckle portion partially extends into the enlarged end of the hole. The pin may then be collapsed by pushing on the free end 126 while supporting the length of the body 128 to prevent it from bending due to its long length. Lowering of the body 128 collapses the knuckles and forces the collapsed knuckles into the broken out portion of the hole as illustrated in FIG. 16 while at the same time moving the strips 130 down into the hole to engage the petals and force them outwardly, thus securing the pin to the board as previously described. Because the upper end of the pin is held down against the upper surface of the board, the knuckles are seated tightly in the broken out end of the hole despite the increase in the diameter of the hole. Upon application of molten solder, solder would flow into the interior of the pin as previously described.

FIGS. 17 and 18 illustrate staking of a circuit board pin 140 to board 142. Pin 140 is identical to pin 10 with the exception that it is formed from sheet metal stock having a thick solder stripe extending along the stock so that a thick layer of solder 144 is secured to the outer surfaces of knuckles 146. Because the solder stripe is continuous, thick layers of solder 148 are also provided on the inner surfaces of strips 150 located adjacent the knuckles.

Pin-receiving circuit board hole 152 extends through the thickness of board 142. A metalized circuit pad 154 surrounds the end of hole 152 on the insertion side of the board. The petals 156 and mounting portion 158 of pin 140 are moved into hole 152 from the pad or insertion side of the board until the knuckles 146 are seated against the pad. Continued movement of the outer tubular body 160 toward board 142 collapses the knuckles 146 against pad 154 and moves the free ends of strips 150 against the camming surfaces of petals 156 to rotate the petals outwardly of the hole and stake the pin to the board as previously described in connection with pin 10.

The desired soldered joint between the pin and pad 154 is formed after staking by heating the collapsed knuckles to melt the thick solder layers 144 so that upon cooling a soldered joint is formed between the collapsed knuckles and pad 154. See FIG. 18. During reflow soldering the solder layers 148 on the interior surfaces of strips 150 melt and recoalesce on the strips. In some applications, this solder may be used to form a soldered connection between the pin and the bared end of a wire inserted into the interior of the inner tubular body 162 prior to reflow soldering. The wire may be inserted into the body through an opening in the end of the body away from board 142 or, alternately, may be positioned in the body laterally before the longitudinal seam is closed. In this regard see the embodiment of FIGS. 20 through 21 described hereinafter.

By providing thick solder layers on the outer surfaces of knuckles 146, it is possible to form reliable electrical connections between staked pins 140 and pads on the circuit board 142 by merely heating the portions of the pins adjacent the pads. The conventional soldering operation involving moving the board above a moltent solder wave is eliminated. In the case that the inner thick solder layers 148 form soldered connections between a conductive wire and the pin, the reflow soldering operation provides a reliable electrical connection between the wire held in the pin and the circuitry on the board. As illustrated in FIG. 18, during staking of the pin to the board the two strips 150 engage the petals 156 and are forced together thus forcing the interior solder layers 148 tightly against a wire previously inserted into the end of the inner body 162. In this way a tight physical connection is assured between the end of the wire and the strips 150 prior to heating of the pin and reflow soldering.

FIGS. 19, 20, and 21 illustrate a crimp-type self staking contact 170 which includes a U-shaped wire crimp barrel 172, a U-shaped insulation crimp barrel 174, four collapsible knuckles 176, a U-shaped mounting portion 178 and three outwardly bendable circuit board-engaging petals 180. The pair of outwardly bowed longitudinal strips 182 extend along the length of the contact from the wire crimp barrel 172 past the knuckles and into the mounting portion 178. The strips 180 join the edges of wire crimp barrel 172 through reverse bends 184.

A stripped wire 186 is positioned within open contact 170 with the bare end 188 of the conductor located in barrel 184 between strips 182. Insulation crimp barrel 174 surrounds the end of the insulation on the wire. The open contact 170 is then crimped closed so that the open sides of the contact as illustrated in FIG. 19 form a longitudinal seam 190 extending the length of the contact and the end of the wire is tightly confined in the closed barrels 184 and 172. During crimping the petals 180 are bent inwardly to permit movement of the petals and circular mounting portion 178 into a circuit board hole.

The lead end of the crimp contact secured to wire 186 is then positioned in circuit board hole 190 extending through the thickness of board 194 and, with further insertion, knuckles 176 are collapsed against the pad 196 on the insertion side of the board and the strips 182 forming the inner tubular body of contact 170 which surrounds wire end 188 are moved downwardly to engage the petals 180 to bend them radially outwardly for engagement with the side of hole 192. Following staking, the board 194 is soldered so that molten solder flows into hole 192 to form a desired soldered joint between the contact and pads 196 and 198 on both sides of board 194 and also a soldered connection between the contact and the stripped end 188 of wire 186. In this way, an interfacial connection is established between the wire and pads on both sides of the board. For certain applications contact 170 may be provided with thick solder layers on the outer surfaces of knuckles 176 and on the inner surfaces of strips 182. Following crimping of the contact onto a wire and staking of the contact and wire to a circuit board, the contact is heated to melt the solder layers and form soldered electrical connection between the knuckles and printed circuit pad on the insertion side of the board and between the wire and the strips defining the inner tubular body. In this case, the need for a separate soldering operation is eliminated.

FIGS. 22 and 23 illustrate a further embodiment of the invention in which a contact 200, similar to contact 170, is crimped to a fiber optic conductor 202 and then staked in a hole 204 extending through a suitable panel 206. The insulation crimp barrel 208 tightly surrounds the insulation of conductor 202 to hold the member to the support. The central fiber optic element 210 is located between the outwardly bowed strips 212 of contact 200 with edges 214 of the strips 212 engaging each other to assure that during crimping and staking of the contact the fiber optic member 210 is not subjected to damaging compressive forces. See FIG. 23.

FIG. 22 illustrates the support 200 secured to a panel 206 with the end of the fiber optic member 210 exposed on the lower or non-insertion side of the panel to either receive light from that side of the panel and transmit the light along the member 202 to a remote terminal or project a ray of light transmitted from a remote source through the fiber optic member to the lower side of the panel. While panel 206 is illustrated as being formed of a plastic material obviously the contact 200 may be secured to ther types of panels as desired. In some applications, the contact may be staked to a blind hole in a transparent material so that light carried by the fiber optic member illuminates the material.

While we have illustrated and described preferred embodiments of our invention, it is understood that these are capable of modification, and we therefore do not wish to be limited to the precise details set forth, but desire to avail ourselves of such changes and alterations as fall within the purview of the following claims.

What we claim as our invention is:

1. A self staking circuit board pin formed from flat metal stock and having a longitudinal axis, said pin comprising an elongate tubular body at one end of the pin, a tubular mounting portion at the other end of the pin, and an axially collapsible portion joining said body and mounting portion, said collapsible portion including a number of knuckles extending radially outwardly beyond the outer surface of the mounting portion, said knuckles being circumferentially spaced around the pin to define solder flow openings between adjacent knuckles, a number of radially outwardly deflectable petals extending from the mounting portion radially inwardly toward the longitudinal axis of the pin beyond the inner surface of the mounting portion, a longitudinal seam extending along the length of the tubular body, and an inner body comprising a pair of elongate segments surrounded by said tubular body and joined to said tubular body at the seam, said inner body extending past the collapsible portion and into the interior of the mounting portion with the end of such body positioned adjacent the radially inwardly extending petals, whereby upon insertion of said mounting portion into a circuit board hole to seat the collapsible portion against one side of the circuit board and collapse of such portion, the end of the inner body is moved toward the petals, engages the petals, and forces the petals radially outwardly to engage the circuit board and secure the pin in the circuit board hole.

2. A self staking circuit board pin as in claim 1 wherein said segments are outwardly bowed along their length and define a hollow continuous solder flow path extending from the mounting portion past the collapsible portion and into the tubular body.

3. A self staking circuit board pin as in claim 1 wherein each knuckle includes a pair of equal length legs joined at an apex and said petals essentially close the interior opening of the mounting portion, each petal being inwardly dished and including a pair of hole-engaging corners on the outside petal surface, and a camming surface on the inside petal surface engagable with the end of the inner body.

4. A self staking circuit board pin as in claim 3 wherein the pin includes four knuckles and three petals.

5. A self staking circuit board pin as in claim 1 including a thick soldered deposit secured to the outer surfaces of said knuckles sufficient to form a soldered joint between the pin and a pad on the circuit board after staking and heating of the pin.

6. A self staking circuit board pin formed from flat metal stock and having a longitudinal axis, said pin comprising an elongate body at one end of the pin, a tubular mounting portion at the other end of the pin, and an axially collapsible portion joining said body and mounting portion and extending radially outwardly beyond the outer surface of the mounting portion, a number of radially outwardly deflectable petals extending from the mounting portion radially inwardly toward the longitudinal axis of the pin beyond the inner surface of the mounting portion, and an inner body joined to said elongate body, said inner body extending past the collapsible portion and into the interior of the mounting portion with the end of such body positioned adjacent the radially inwardly extending petals, whereby upon insertion of said mounting portion into a circuit board hole to seat the collapsible portion against one side of the circuit board and collapse such portion, the end of the inner body is moved toward the petals, engages the petals, and forces the petals radially outwardly to engage the circuit board pin and secure the pin in the circuit board hole.

7. A self staking circuit board pin as in claim 6 wherein each petal is inwardly dished and includes a pair of hole-engaging corners on the outside petal surface and a camming surface on the inside petal surface engagable with the end of the inner body.

8. A self staking circuit board pin as in claim 7 wherein said inner body is tubular and defines a hollow continuous solder flow path extending from the mounting portion past the collapsible portion and into the elongate body.

9. A self staking circuit board pin as in claim 8 wherein said elongate body is hollow along its length and surrounds the inner body, the inner body extending to the free end of the elongate body.

10. A contact formed from flat metal stock and having a longitudinal axis, said contact comprising an outer hollow body at one end of the contact, a tubular mounting portion at the other end of the contact, a collapsible portion between said body and mounting portion, means at the free end of the mounting portion engagable with a support, and an inner elongate body surrounded by said outer hollow body, said inner elongate body extending past the collapsible portion and into the interior of the mounting portion to move the means into engagement with a support upon collapse of said collapsible portion, and a longitudinal seam extending along said outer hollow body, said inner elongate body joining said outer body through a reverse bend portion at the seam.

11. A contact as in claim 10 wherein said inner elongate body includes a pair of outwardly bowed strips each joined to said outer body at the seam by a reverse bend portion.

12. A contact as in claim 11 wherein said means at the free end of the mounting portion includes a number of radially outwardly bendable petals extending radially inwardly, and the end of said inner elongate body is located adjacent said petals so that upon collapse of the collapsible portion the end of the inner elongate body engages the petals and forces them radially outwardly.

13. A self staking contact having an axis and comprising a hollow mounting portion adapted to be positioned within a hole in a support such that the contact axis is parallel to or coincident with the axis of the hole, a contact portion on the axis spaced from said mounting portion, axially collapsible means joining the mounting and contact portions, a seam extending axially along the contact portion, a two-part staking portion within the contact having an end surrounded by or immediately adjacent to the hollow mounting portion, the parts of said staking portion joining said contact portion through reverse bends at the seam, the mounting portion including inwardly extending and outwardly deformable members located in the path of movement of said staking portion upon axial collapse of said collapsible means for radial outward movement thereof and engagement with the sides of the hole in the support to secure the contact to the support.

14. A panel contact as in claim 13 wherein contact is formed from uniform thickness sheet metal stock and said members each have a camming surface on the inside thereof and a pair of support-engaging corners on the outside surface thereof, said corners being spaced radially outwardly from said camming surface a distance greater than the thickness of said stock.

15. A panel contact as in claim 13 wherein said contact means comprises an elongate pin.

16. A panel contact as in claim 13 wherein said contact means comprises a crimp barrel.

17. A panel contact as in claim 17 including an elongate conductor, an end of the conductor extending into and crimped within said barrel.

18. A panel contact as in claim 17 wherein said conductor comprises an electrically conductive element.

19. A self staking support contact as in claim 17 wherein said conductive element comprises a light conductive element and wherein the free end of the element is exposed at the mounting portion.

20. A self staking support contact comprising a U-shaped mounting portion, a crimp barrel, a collapsible portion joining said mounting portion and crimp barrel, inwardly extending outwardly bendable members extending from the free end of the mounting portion, and a staking member integrally joined to the crimp barrel and extending past the collapsible portion and into or adjacent said mounting portion whereby upon closing of the mounting portion and crimp barrel about a conductor, positioning of the mounting portion in a hole extending into a support and collapse of said portion the deflecting member engages the petals and forces them radially outwardly to bite into the walls of the hole and secure the element to the support.

21. A contact as in claim 20 including a means for engaging a conductor.

22. A contact as in claim 20 including thick solder coatings on the outer surfaces of said knuckles and on the inner surfaces of said strips.

23. A self staking circuit board pin as in claim 22 including a thick solder deposit on the inner surfaces of said segments adjacent said knuckles.

24. A self staking support element as in claim 20 wherein said staking member includes a pair of strips extending from the crimp barrel into the mounting portion and joining the crimp barrel at reverse bends at the edges thereof.

25. A contact as in claim 24 wherein the strips are outwardly bowed.

* * * * *